US010378178B2

(12) United States Patent
Andritzky

(10) Patent No.: US 10,378,178 B2
(45) Date of Patent: Aug. 13, 2019

(54) SYSTEM AND METHOD FOR PRODUCING A PRECISELY FITTING ATTACHMENT BLADE AND A CORRESPONDING EXCAVATOR SCOOP

(71) Applicant: Franz Kassecker GMBH, Waldsassen (DE)

(72) Inventor: Josef Andritzky, Konnersreuth (DE)

(73) Assignee: Franz Kassecker GmbH, Waldsassen (DE)

( * ) Notice: Subject to any disclaimer, the term of this patent is extended or adjusted under 35 U.S.C. 154(b) by 0 days.

(21) Appl. No.: 15/938,096

(22) Filed: Mar. 28, 2018

(65) Prior Publication Data

US 2018/0266073 A1 Sep. 20, 2018

Related U.S. Application Data

(63) Continuation of application No. PCT/EP2016/001583, filed on Sep. 22, 2016.

(30) Foreign Application Priority Data

Sep. 28, 2015 (DE) ..... 10 2015 012 681
Sep. 28, 2015 (DE) ..... 20 2015 006 848 U

(51) Int. Cl.
*E02F 3/96* (2006.01)
*E02F 3/40* (2006.01)
*E02F 9/28* (2006.01)

(52) U.S. Cl.
CPC ..... *E02F 3/962* (2013.01); *E02F 3/40* (2013.01); *E02F 9/2816* (2013.01); *E02F 9/2883* (2013.01)

(58) Field of Classification Search
CPC . E02F 3/962; E02F 3/40; E02F 9/2816; E02F 9/2883
See application file for complete search history.

(56) References Cited

U.S. PATENT DOCUMENTS 3,160,967 A * 12/1964 Nichols ..... E02F 3/8152 172/753
3,307,277 A * 3/1967 Kondracki ..... E02F 9/2808 37/450
3,456,370 A * 7/1969 Gilbertson ..... E02F 3/8152 172/701.2

(Continued)

FOREIGN PATENT DOCUMENTS

JP 9-137477 9/1979
JP S50113203 U 9/1979

(Continued)

*Primary Examiner* — Jamie L McGowan
(74) *Attorney, Agent, or Firm* — Von Rohrscheidt Patents

(57) ABSTRACT

A system and a method configured to produce a precisely fitted attachment blade and a corresponding excavator scoop and templates configured to produce a precisely fitted attachment blade and a corresponding excavator scoop. Thus a transportation requirements to a construction site can be significantly reduced. Furthermore attachment blades for particular excavator scoops can be produced quickly for particular excavator scoops and excavator scoops can be configured with tooth holders. Furthermore existing attachment blades and excavator scoops can be regenerated quickly when service is required.

6 Claims, 4 Drawing Sheets

(56) References Cited

U.S. PATENT DOCUMENTS 3,685,177 A * 8/1972 Hahn ..... E02F 9/2833 37/446
3,765,109 A * 10/1973 Daviduke ..... E02F 3/401 37/449
3,851,413 A * 12/1974 Lukavich ..... E02F 9/2816 37/450
3,984,929 A * 10/1976 Meyer ..... E02F 9/2816 37/449
3,997,988 A * 12/1976 Klett ..... E02F 9/2825 37/450
4,006,544 A * 2/1977 Stepe ..... E02F 3/40 172/701.2
4,043,060 A * 8/1977 Stepe ..... E02F 3/401 37/446
5,918,389 A * 7/1999 Hall ..... E02F 3/8152 37/407
6,070,345 A * 6/2000 Akaki ..... E02F 3/40 37/407
7,266,914 B2 * 9/2007 Grant ..... E02F 3/40 37/444
7,581,340 B2 * 9/2009 Wolfe ..... E02F 3/402 37/407
2003/0061744 A1 * 4/2003 Leslie ..... E02F 9/2816 37/452
2004/0060209 A1 * 4/2004 Watanabe ..... E02F 9/2825 37/452

FOREIGN PATENT DOCUMENTS

| | | |
|---|---|---|
| JP | S54131703 | 9/1979 |
| JP | H0978637 | 3/1997 |
| JP | H11148149 | 6/1999 |
| JP | 2001323518 | 11/2001 |
| JP | 2006016906 | 1/2006 |
| KR | 20080044978 | 5/2008 |

* cited by examiner

SYSTEM AND METHOD FOR PRODUCING A PRECISELY FITTING ATTACHMENT BLADE AND A CORRESPONDING EXCAVATOR SCOOP

RELATED APPLICATIONS

This application is a continuation of International Application PCT/EP2016/001583 filed on Sep. 22, 2016 claiming priority from German Patent Applications
DE 10 2015 012 681.4 filed on Sep. 28, 2015, and
DE 20 2015 006 848.0 filed on Sep. 28, 2015,
all of which are incorporated in their entirety by this reference.

FIELD OF THE INVENTION

The instant invention relates to system and method for producing a precisely fitted attachment blade and a corresponding excavator scoop.

Excavator scoops, in particular top hinged scoops and bottom hinged scoops are used in many construction applications. Thus, material can be dug out and digging can be performed. Thus, the excavator scoop advantageous includes teeth which facilitates penetration into material to be loaded and the material is loosened as well. Through various tooth configurations and shapes efficient pick up of the material to be loaded, this means optimum penetration of the excavator scoop into the material to be loaded can be provided.

According to the instant invention no differentiation is made between scoops and buckets. The invention is not limited to excavators either but the scoops and buckets shall also be useable for loaders. The term excavator scoop is thus used synonymously for all types of buckets and scoops of earth moving equipment.

In the many applications for digging up soil in addition to penetration capabilities also levelness of ground, in particular for pipe construction is important. When excavator scoops shall be used for example also for grading or leveling of ground areas the excavator scoop should have a flat digging edge. Also here less economical operations with approximately 20% higher fuel expense through increased energy consumption when penetrating into the material to be excavated is acceptable in return for the levelness of the ground. A digging edge can be provided on the one hand side by excavator scoops without teeth but also by providing removable tooth attachments which are applied to respective tooth holders at the excavator scoop, wherein an attachment blade can be attached at the excavator scoop after removing the tooth attachments by using the tooth holder. Rather closely standing wide teeth can also be used which facilitate a closed front edge of the excavator scoop.

In order to produce an attachment blade a cutting element is typically used that has a series of tooth attachments attached to it. It is a problem that there are different tooth systems where a tooth spacing and tooth position are not defined since teeth are arranged at outer edges at a slant angle for different manufacturers in order to achieve a clearance. Thus, individual attachment blades have to be stocked for each bucket. Furthermore damages occur over and over again at the excavator scoop and/or at the attachment blade so that replacement has to be found onsite. Due to the individual conditions a required attachment blade can then only be produced by applying tooth attachments to the tooth holders at the respective bucket and by welding the tooth attachments to the cutting element.

However when the excavator scoop is damaged a correct repair has to be performed in a specialized shop which causes a high amount of transport time and transport expense.

Since the elements bucket, cutting element, tooth holder and tooth attachment partially are cast components they have rather high tolerances which have to be considered. Furthermore displacement through overloads of the tooth attachments arranged thereon can occur between individual tooth holders during operations.

In order to provide a solution it was already proposed to configure the attachment of the tooth attachments of the attachment blades on the tooth holders of the excavator scoops in a flexible manner. For example slotted holes that extend parallel to the cutting edge can be provided for this purpose according to JP 9-137477 so that the tooth attachments are attached at the cutting element with a rather large lateral clearance so that the relative position to the tooth holder is adjusted. An alternative solution with even larger lateral clearance provides tooth attachments that are inserted in a dove tail support of the cutting element according to JP 11-148149. It is a disadvantage of these solutions that they have a complex configuration and are rather prone to getting damaged since the attachment is not as rigid and as stable as a weld.

Therefore these solutions have not been commercially successful. Instead there is a lot of improvising in practical applications due to a lack of time and a lack of site preparation which causes expenses that are difficult to quantify.

BRIEF SUMMARY OF THE INVENTION

Thus, it is an object of the instant invention to overcome the disadvantages. In particular transportation expense to the construction site shall be significantly reduced, attachment blades for particular excavator scoops shall be quickly producible on site and attachment blades and excavator scoops shall be quickly serviceable when service is required.

This object is achieved by a reusable template for producing an attachment blade with a cutting element and at least two tooth attachments attached at the cutting element, wherein the reusable template for attachment of the at least two tooth attachments is not an excavator scoop, and wherein the reusable template for the attachment of the at least two tooth attachments includes a number of tooth holders that corresponds to a number of the at least two tooth attachments.

The object is also achieved by a reusable template for producing an excavator scoop with at least two tooth holders attached thereto, wherein the reusable template for attachment of the tooth holders is not an attachment blade, and wherein the reusable template for attachment of the tooth holders includes a number of second tooth attachments that corresponds to a number of the tooth holders to be attached thereto, wherein the second tooth attachments are arranged at a predetermined distance from each other.

Last not least the object is achieved by a method for producing a precisely fitted attachment blade or a corresponding excavator scoop, wherein the attachment blade includes a cutting element and at least two tooth attachments attached at the cutting element, wherein the excavator scoop includes a bucket and at least two tooth holders corresponding to the tooth attachments of the attachment blade, wherein a reusable template is used for attaching at least one tooth attachment at the cutting element or a reusable template is used for the attachment of at least one tooth holder at the bucket, wherein the reusable template for the attachment of the tooth attachments is not an excavator scoop and the reusable template for the attachment of the tooth holders is not an attachment blade, wherein the reusable template for attachment of the tooth attachments includes a number of tooth holders that corresponds to a number of tooth attachments to be attached, wherein the tooth holders are arranged at a predetermined distance from each other, the reusable template for attachment of the tooth holders includes a number of second tooth attachments that corresponds to the number of the tooth holders to be attached, wherein the second tooth attachments are arranged at a predetermined distance from each other.

The inventors have found that the object is achieved in a surprisingly simple manner when no individual solution is provided but templates are used for attaching the tooth holders and the tooth attachments. This facilitates a substantial standardization which on the one hand side only requires stocking a very small number of tools and on the other hand side provides a simple and quick onsite solution which is substantially free from improvisation.

This was not the case so far since the manufacturers offered excavator scoops with tooth holders arranged thereon, however distances of the tooth holders from each other were not the same for two excavator scoops of the same type thus they were randomly attached at the factory. Cutting elements are also offered by manufacturers but only as an accessory and they are not provided with tooth attachments. The attachment of the tooth attachments has to be provided by the end user himself and this is also done in an improvised manner.

The system according of the invention to produce a precisely fitting attachment blade and a corresponding excavator scoop wherein the attachment blade includes a cutting element and at least two tooth attachments attached thereto and wherein the excavator scoop includes a bucket and at least two tooth holders that correspond with the tooth attachments of the attachment blade, wherein the system includes a bucket and a cutting element that is disengageable from the bucket and it therefore is characterized by at least one template for attaching the tooth attachments at the cutting element and at least one template for attaching the tooth holders at the bucket.

Thus it is provided that the template for attaching the tooth attachments is no excavator scoop and the template for attaching the tooth holders is no attachment blade. Therefore these are templates that are only used for production but not for construction work.

It is described in JP 9-13 7477 that a cutting attachment is provided with tooth attachments that are adaptable to the tooth holders of an excavator scoop. Thus, an individual cutting attachment can be adapted to various excavator scoops and in particular to positions of the tooth holders that are changed by operations. However, no template according to the instant invention is provided since no uniform system with standardized dimensions can be provided but merely an improvisation for particular excavator scoop dimensions.

In an advantageous embodiment it is provided that the system is used for producing a precisely fitted attachment blade and a corresponding uniform excavator scoop respectively with repeatable dimensions. Repeatable means in this context that a series of excavator scoops and attachment blades can be produced which respectively have identical dimensions wherein any time period can lapse between the production of the excavator scoops or the attachment blades since the respective templates are only used for producing the elements and for nothing else, thus in particular not to perform work.

In an advantageous embodiment it is provided that the attachment is a non-disengageable fixation, advantageously a welded connection.

In an advantageous embodiment it is provided that the system includes a cutting element without tooth attachments attached thereto and/or a bucket without tooth holders or additional tooth attachments or tooth holders attached thereto. Thus, new attachment blades or excavator scoops can be produced. Alternatively or additionally the system can also include existing excavator scoops with tooth holders and/or attachment blades with tooth attachments attached thereto. Thus the positions of the tooth holders or tooth attachments can be corrected when service is required or the tooth holders and tooth attachments can be replaced.

In an advantageous embodiment it is required that the tooth holders and the tooth attachments are made to production standards, for example the companies cargo MTG, Caterpillar, Bofors, Lenhoff or ESCO provide corresponding components.

In an advantageous embodiment it is provided that the template for attaching the tooth attachments includes a number of tooth holders that corresponds to the number of the tooth attachments to be attached. Attached wherein the tooth holders are arranged at a defined distance from each other, wherein the tooth holders are attached on a common first base, and/or wherein the template for attaching the tooth holders includes a number of tooth attachments that corresponds to the number of tooth holders to be attached wherein the tooth attachments are arranged at a predetermined distance from each other wherein the tooth holders are a advantageously attached on a common second base. In particular the predetermined distance is constant.

Furthermore the distance is advantageously scaled. This means that the distance is selected as a function of the width of the excavating bucket, for example for equally spaced tooth attachments or tooth holders are used for width of the bucket of 500 mm and 600 mm which corresponds to a distance of 166.67 mm or 200 mm and for a width of 800 mm five tooth attachments or tooth holders are being used which corresponds to a distance of 160 mm, thus not the distance is scaled but the number of teeth with reference to the width of the bucket. For larger widths of the buckets a corresponding larger number of tooth holders and tooth attachments is used.

In an advantageous embodiment it is provided that the outside tooth holders of the excavator scoop are arranged so that a clearance is provided and the excavator scoop itself does not cut into the material to be dug up during digging.

In an advantageous embodiment it is provided that the templates are produced so that the base of the excavator scoop and the base of the attachment blade are in one plane.

In an advantageous embodiment it is provided that the template for attaching the tooth holders includes a stop edge for the bucket and/or that the template for attaching the tooth attachments includes a stop edge for the attachment blade. Then the distance between attachment blade and excavator scoop can be adjusted very precisely.

In an advantageous embodiment it is provided that the templates for the excavator scoops and attachment blades are produced so that the cutting element of the attachment blade contacts the bucket directly when the attachment blade is arranged at the excavator scoop. Due to the precision fit that is achieved by the template fabrication no large gap has to be maintained so that no compensation plates are required.

In an advantageous embodiment it is provided that the template for attaching the tooth attachments and the template for attaching the tooth holder are provided as uniform one piece template. Then only a single component is provided so that transport complexity to the construction site is reduced.

In an advantageous embodiment it is provided that templates have markers, for example configured as different colors or signs that indicate their application to the user so that no mix up can occur.

In an advantageous embodiment it is provided that all tooth attachments on the template for producing the excavator scoops are oriented parallel to each other with reference to their longitudinal axes and all tooth holders on the template for producing the attachment blade are arranged parallel to each other with respect to their longitudinal axes. Then excavator scoops and attachment blades can be produced with the templates with a particularly simple manner because the templates can be pulled off easily.

Independent protection is claimed for the template according to the invention for producing an attachment blade with a cutting element and at least two tooth attachments attached thereon, wherein the template includes the features of the template for producing an attachment blade for the system according to the invention.

Independent patent protection is furthermore claimed for the template according to the invention for producing an excavator scoop with at least two tooth holders attached thereon wherein the template includes the features of the system according to the invention that relate to the features of the template for producing an excavator scoop.

In an advantageous embodiment it is provided that at least one of the templates according to the invention is used for producing an element with repeatable dimensions wherein the element is the attachment blade or the excavator scoop.

Independent patent protection is furthermore claimed for the method according to the invention to produce a precisely fitted attachment blade and a corresponding excavator scoop wherein the attachment blade includes a cutting element and at least two tooth attachments that are attached thereto and wherein the excavator scoop includes a bucket and at least two tooth holders that correspond to the tooth attachments of the attachment blade, characterized in that a template is used for attaching at least one tooth attachment at the cutting element and for attaching at least one tooth holder at the bucket.

In an advantageous embodiment that the attachment blade and the excavator scoop include a reproducible dimension.

Alternatively only one excavator scoop can be provided with at least one tooth holder or an attachment blade can be provided with at least one tooth attachment, wherein the respective template is used. Also in this embodiment a high level of repeatable precision is achieved for the produced excavator scoops or attachment blades.

Alternatively also only one excavator scoop can be provided with at least one tooth holder or an attachment blade can be provided with at least one tooth attachment wherein the respective template is used. Also in this case a high level or repeat precision is achieved for the excavator scoops or attachment blades that are produced.

In an advantageous embodiment it is provided that the system according to the invention and/or at least one of the templates according to the invention are used.

In an advantageous embodiment it is provided that the template for attaching the tooth holders is produced using the template for attaching the tooth attachments or that the template for attaching the tooth attachments is produced using the template for attaching the tooth holders. This simplifies producing the templates significantly. Advantageously the template for attaching the tooth holders is produced first since this facilitates the desired configuration of the excavator scoop and of the required clearance.

In an advantageous embodiment it is provided that the template for attaching the tooth attachments and the template for attaching the tooth holders are produced so that all teeth can be arranged laterally centered on the corresponding tooth holders. Then clearances caused by the tolerances in the tooth holders and tooth attachments are used in an optimum manner.

In an advantageous embodiment it is provided that the templates are produced by welding the tooth attachments and/or the tool holders down. This attachment type is particularly permanent.

In an advantageous embodiment it is provided that the template for attaching the tooth attachments is produced so that a height of a first base is exactly the same as a height of the bucket base and/or that a height of the second base is exactly the same as the height of the cutting element.

BRIEF DESCRIPTION OF THE DRAWINGS

Characterizing features and further advantages of the instant invention are subsequently described based on an advantageous embodiment with reference to drawing figures, wherein.

DETAILED DESCRIPTION OF THE INVENTION

Figure 1:
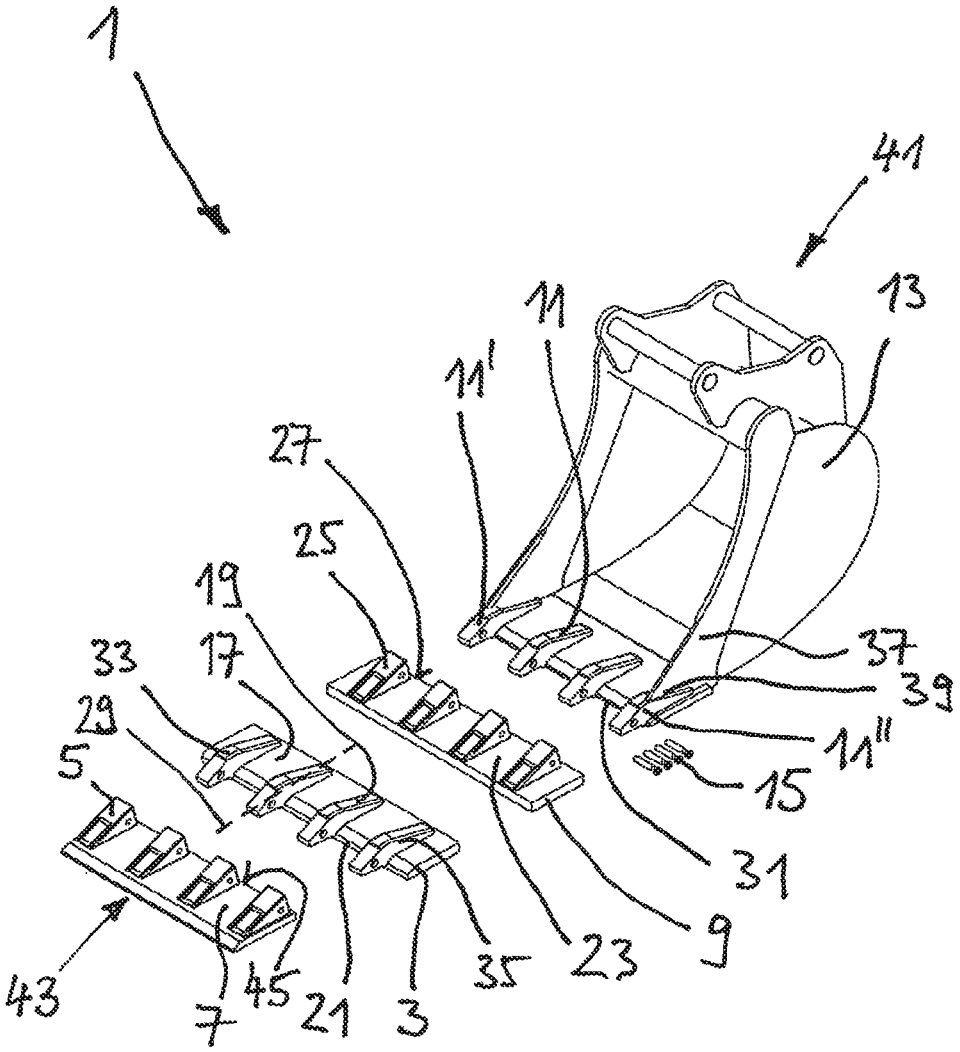
FIG. 1 illustrates the system according to the invention.

FIG. 1 illustrates the system 1 according to the invention. It is evident that the system 1 includes a template 3 for attaching the tooth attachments 5 at a cutting element 7 and a template 9 for attaching the tooth holders 11, 11', 11" at a bucket 13. The system 1 furthermore includes bolts 15 for connecting the tooth attachments 5 and the tooth holders 11 with the respective template 3, 9. Instead of the bolts 15 also wedges and similar can be used.

The template 3 includes a base 17 at which tooth holders 19 are arranged at a uniform lateral distance of 250 mm with reference to the center of the tooth holders 19 by welding. The base 17 has a contact edge 21.

The template 9 has a base 23 at which tooth attachments 25 are arranged at a uniform lateral distance of 250 mm with reference to the center of the tooth attachments 25 by welding. The base 23 also has a contact edge 27.

In order to produce the templates 3, 9 the base 17 was initially configured with the tooth holders 19 wherein the tooth holders 19 are arranged parallel to each other with their longitudinal axes 29 and arranged offset relative to each other with their centers by 250 mm respectively. The base 17 has a lateral extension that is 250 mm greater than the width of the cutting edge 31 of the bucket of 750 mm. The two outer tooth holders 33, 35 then have been arranged on the base 17 so that their centers are respectively arranged at a dimension of 125 mm or 875 mm with reference to a lateral extension of the base 17. Thereafter the base 17 was welded together with the tooth holders 19.

The template 3 thus generated was then used for producing the template 9. Thus, the base 23 has the same lateral extension as the base 17. The tooth attachments 25 were then applied to the corresponding tooth holders 19 and fixed by the bolts 15. Thus, the tooth attachments 25 are respectively centrally aligned in a lateral direction with reference to the tooth holders 19 in order to use the existing tolerance in an optimum manner. The contact edge 21 of the base 17 is then brought in contact with the contact edge 27 of the base 23 and the base 23 is welded together with the tooth attachments 25. Subsequently the bolts 15 were removed again and the template 9 was removed.

The fabricated templates 3, 9 are now being used as follows. Using the template 9 the tooth holders 11, 11', 11" are precisely aligned at the bucket 13, thus the tooth holders 11, 11', 11" are laterally centrally arranged in the tooth attachments 25 and fixed by the bolts 15. Subsequently the tooth holders 11, 11', 11" are arranged at the bucket 9 using the template 9 so that the stop edge 27 contacts the cutting edge 31. In order to envelop the side lobes 37 of the bucket with the tooth holders 11, 11', the side lobes are provided with corresponding transversal cut outs 39 so that the tooth holders 11', 11" can be applied and welded together with the side lobes 37. Subsequently the tooth holders 11, 11' 11" are welded together with the bucket 13, wherein in particular the longitudinal recesses 39 are welded together with the side lobes 37. Subsequently the bolts 15 were pulled out again and the template 9 was removed.

Figure 2A:
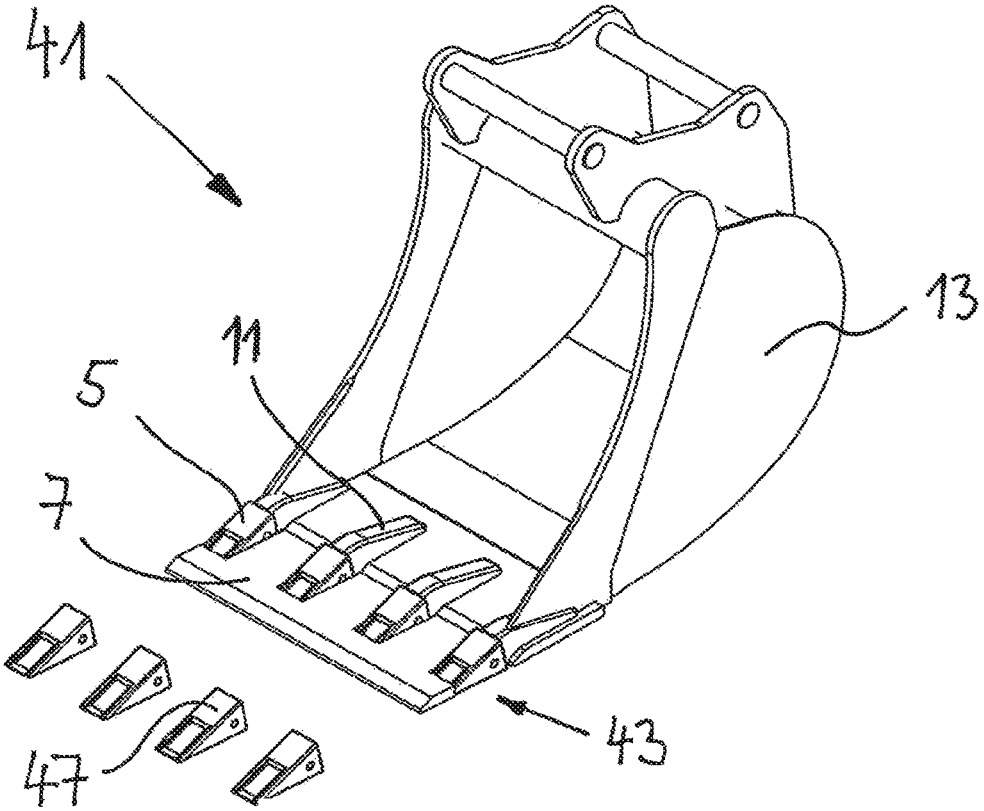
FIGS. 2A, 2B illustrate the excavator scoop according to the invention with an attachment blade that is produced according to the invention and individual tooth attachments in different applications.
Figure 2B:
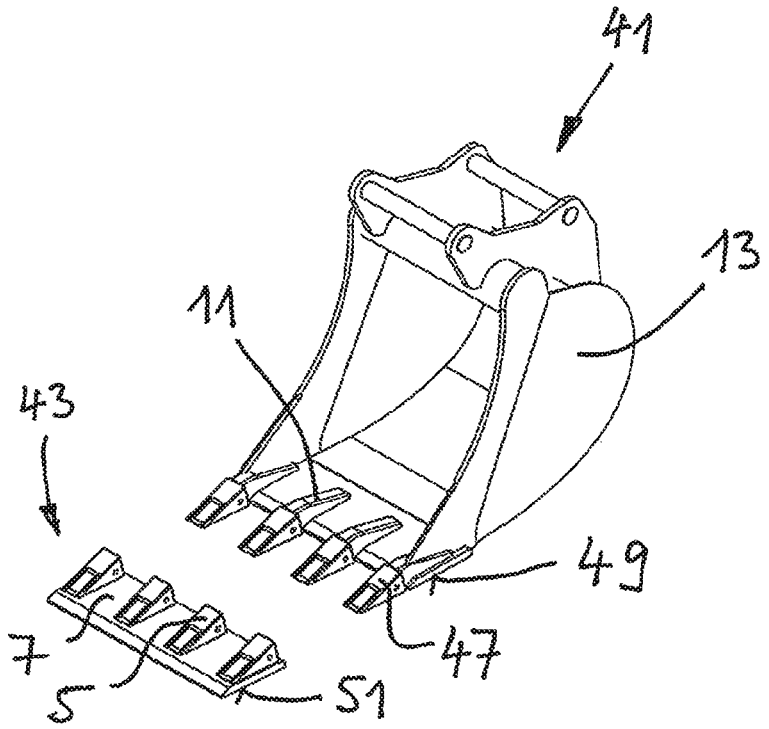

This has generated an excavator scoop 41 (c.f. FIGS. 2*a*, 2*b*) which includes tooth holders 11, 11', 11" with a standard arrangement wherein their longitudinal axes are parallel to each other. The outer tooth holders 11', 11" thus protrude beyond the side lobes 37 so that a clearance is provided so that the side lobes 37 are unloaded when the excavator scoop is being used.

In order to produce the attachment blade 43 the tooth attachments 5 are centrally applied to the tooth holders 19 of the template 3 and arrested by the bolts 15. The cutting element 7 is applied with its contact edge 45 to the contact edge 21 of the template 3 and laterally centrally aligned with respect to the template 3. Thereafter the tooth attachments 5 are welded together with the cutting elements 7. The bolts 15 are extracted and the template 3 is removed (c.f. FIG. 2*b*). Advantageously it is provided however that the cutting element 7 is recessed in the portion of the tooth attachments 5 and the tooth attachments 5 are then inserted into the cutting element 7 and welded together therewith.

Figure 3:
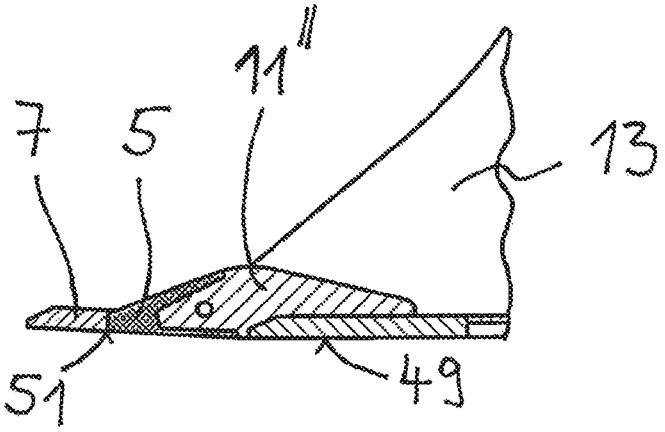
FIG. 3 illustrates the excavator scoop produced according to the invention with the attachment blade produced according to the invention attached according to FIG. 2A in a cross sectional view.

The attachment blade 43 (c. f. FIGS. 2*a*, 2*b*, 3) thus produced now includes tooth attachments 5 which are spaced according to a uniform standard and arranged parallel to each other with their longitudinal axes, wherein the arrangement is precisely adjusted to the arrangement of the tooth holders 11, 11', 11" of the excavator scoops 41. According to FIGS. 2*a*, 2*b* and 3 the excavator scoop 41 thus produced can be combined with individual tooth attachments 47 for digging or with the produced attachment blade 43 for grading. Using the templates 3, 9 provides a precise standardization so that the attachment blade 43 and the excavator scoop 41 are precisely aligned with each other, wherein the cutting edge 31 of the excavator scoops 41 contacts the stop edge 45 of the attachment blade 43 and the basis 49, 51 of the bucket 13 and of the attachment blade 43 are arranged in one plane (c.f. FIGS. 2*a* and 3).

This is evident in particular from FIG. 3 which shows that the bases 49, 51 of the bucket 13 and the cutting element 7 are adjusted to each other so that they are at one level. Thus resistance during ground processing is significantly reduced. This is facilitated in that the height of the base 23 is exactly the same as the height of the cutting element 7 and the height of the cutting element 7 and the height of the first base 17 is exactly the same as the height of the bucket base 49.

Additionally resistance is significantly improved in that the tooth attachments 5 are arranged in the cutting element 7 and are not only applied thereto. Thus recesses are cut out from the cutting element 7 in order to attach the tooth attachments 5, the tooth attachments 5 are inserted into the recesses and thereafter the tooth attachments 5 are welded together with the cutting element 7.

The latter feature is achieved in that a thicknesses of the cutting element 7 and the base 17 and the base 23 are the same.

Using the templates 3, 9 new excavator scoops 41 and new attachment blades 43 can be easily produced at a construction site or positions of the tooth holders 11, 11', 11" and of the tooth attachments 5 can be corrected precisely fitting or tooth holders 11, 11', 11" and tooth attachments 5 can be replaced precisely fitting when service is required.

In addition to the cited advantages of simplified production and maintenance with minimum stock requirements for essential parts an additional advantage is that much fewer tools have to be provided due to the standardization. Typically when using 3 excavators at a construction site 5 different attachment tools, namely 3 different tooth attachments and 2 different attachment blades have to be provided, thus 15 different tools since the individual excavator scoops are all different models. Now however only 5 different tools are used which fit universally at all 3 excavators. If individual excavators have excavator scoop s with a different operating width than only different attachment blades have to be provided per operating width.

From the preceding description it is evident that the instant invention significantly reduces transport requirements to the construction site. Thus attachment blades for particular excavators are quickly produce able at a construction site and excavator scoops are also retro fit able with tooth holders. Furthermore existing attachment blades and excavator scoops can be reconditioned quickly when service is required.

Unless stated differently all features of the instant invention freely combinable with each other. Also the features described in the figure description unless stated differently can be freely combined with the other features of the invention, Thus instant features of the system and of the templates can also be used as method features and method features can be used as apparatus features.

REFERENCE NUMERALS AND DESIGNATIONS

1 system
3 template
4 attachment blade
5 tooth attachment
7 cutting element of attachment blade 43
9 template for excavator scoop
11, 11' 11" tooth holder
13 bucket
15 bolt

17 base of template 3
19 tooth holder
21 stop edge of template 3
23 base of template 9, second base
25 tooth attachment
27 contact edge of template 9
29 longitudinal axes of tooth holders 19, 22, 25
31 cutting edge of bucket 13
33, 35 outer tooth holder
37 side lobes of bucket 13
39 transversal cut out in side lobes 37
41 excavator scoop
43 attachment blade, attachment cutting edge
45 contact edge of attachment blade 43
47 tooth attachment
49, 51 base of bucket 13 and cutting element 7

What is claimed is:

1. A system configured to produce a precisely fitted attachment blade and a corresponding excavator scoop, the system comprising:

a bucket and a cutting element that is disengageable from the bucket, wherein the attachment blade includes the cutting element and at least two first tooth attachments attached at an external top surface of the cutting element that is oriented towards a pivot of the excavator scoop, and wherein the excavator scoop includes the bucket and at least two first tooth holders that correspond to the at least two first tooth attachments of the attachment blade;

at least one reusable first template for aligning the at least two first tooth attachments at the cutting element, wherein the at least one reusable first template for aligning the at least two first tooth attachments is not an excavator scoop, wherein the at least one reusable first template for aligning the at least two first tooth attachments includes a number of second tooth holders that corresponds to a number of the at least two first tooth attachments, and wherein the number of the second tooth holders is attached at an external top surface of the at least one reusable first template that is oriented towards the pivot of the excavator scoop; and at least one reusable second template for aligning the at least two first tooth holders at the bucket, wherein the at least one reusable second template for aligning the least two first tooth holders is not an attachment blade, wherein the least two first tooth holders are arranged at a predetermined distance from each other, wherein the at least one reusable second template for aligning the least two first tooth holders includes a number of second tooth attachments that corresponds to the number of the tooth holders to be aligned, wherein the second tooth attachments are arranged at a predetermined distance from each other, wherein the second tooth attachments attached at an external top surface of the at least one reusable second template that is oriented towards the pivot of the excavator scoop, and wherein the at least one reusable first template for attaching the at least two tooth attachments and the at least one reusable second template for attaching the tooth holders at the bucket are integrally provided as a uniform one-piece reusable template.

2. The system according to claim 1, wherein the second tooth holders of the at least one reusable first template are attached at a common first base, or wherein the second tooth attachments of the at least one reusable second template for aligning the at least two first tooth holders are attached at a common second base, and wherein the common first base and the common second base are integrally provided in one piece.

3. The system according to claim 1, wherein all second tooth attachments on the at least one reusable second template for producing the excavator scoop are arranged parallel to one another with their longitudinal axes, and wherein all second tooth holders on the at least one reusable second template for producing the attachment blade are arranged parallel to each other with respect to their longitudinal axes.

4. A method for producing a precisely fitted attachment blade and a corresponding excavator scoop, the method comprising the steps:

using a system including:

a bucket and a cutting element that is disengageable from the bucket, wherein the attachment blade includes the cutting element and at least two first tooth attachments attached at an external top surface of the cutting element that is oriented towards a pivot of the excavator scoop, and wherein the excavator scoop includes the bucket and at least two first tooth holders that correspond to the at least two first tooth attachments of the attachment blade;

aligning the at least two first tooth attachments at the cutting element using the at least one reusable first template, wherein the at least one reusable first template for aligning the at least two first tooth attachments is not an excavator scoop, wherein the at least one reusable first template for aligning the at least two first tooth attachments includes a number of second tooth holders that corresponds to a number of the at least two first tooth attachments, and wherein the number of the second tooth holders is attached at an external top surface of the at least one reusable first template that is oriented towards the pivot of the excavator scoop; and aligning the at least two first tooth holders at the bucket using the at least one reusable second template, wherein the at least one reusable second template for aligning the least two first tooth holders is not an attachment blade, wherein the least two first tooth holders are arranged at a predetermined distance from each other, wherein the at least one reusable second template for aligning the least two first tooth holders includes a number of second tooth attachments that corresponds to the number of the tooth holders to be aligned, wherein the second tooth attachments are arranged at a predetermined distance from each other, wherein the second tooth attachments attached at an external top surface of the at least one reusable second template that is oriented towards the pivot of the excavator scoop, and wherein the at least one reusable first template for attaching the at least two tooth attachments and the at least one reusable second template for attaching the tooth holders at the bucket are integrally provided as a uniform one-piece reusable template.

5. The method according to claim 4, further comprising the steps:

producing the at least one reusable first template for aligning the at least two first tooth attachments and the at least one reusable second template for aligning the at least two first tooth holders so that the at least two first tooth attachments are laterally centrally arrangeable on the corresponding tooth holders of the at least two first toot holders, wherein the at least one reusable first template and the at least one reusable second template are produced by welding the at least two first tooth attachments and the at least two first tooth holders down.

6. The method according to claim 4, wherein the at least one reusable first template for attaching the at least two first tooth attachments is produced so that a height of the first base is exactly the same as a height of a bucket base and a height of the second base is exactly the same as a height of the cutting element.

* * * * *